US011384754B2

(12) United States Patent
Mattock et al.

(10) Patent No.: US 11,384,754 B2
(45) Date of Patent: Jul. 12, 2022

(54) METHOD AND SYSTEM OF SLOW RATE PUMPING

(71) Applicant: SANJEL ENERGY SERVICES INC., Calgary (CA)

(72) Inventors: Ben Mattock, Calgary (CA); Charlie Eykelbosh, Calgary (CA); Jeff Spence, Calgary (CA); Josh Seens, Calgary (CA); Liguo Zhou, Calgary (CA); Daniel Blair Fisher, Grande Prairie (CA); Bilal Abdurahman, Chestermere (CA); Neville Dholoo, Calgary (CA)

( * ) Notice: Subject to any disclaimer, the term of this patent is extended or adjusted under 35 U.S.C. 154(b) by 0 days.

(21) Appl. No.: 17/363,277

(22) Filed: Jun. 30, 2021

(65) Prior Publication Data

US 2021/0324847 A1 Oct. 21, 2021

Related U.S. Application Data

(63) Continuation of application No. 16/125,804, filed on Sep. 10, 2018, now Pat. No. 11,078,901.

(51) Int. Cl.

| | |
|---|---|
| ***F04B 49/08*** | (2006.01) |
| ***F04B 1/00*** | (2020.01) |
| ***F04B 49/22*** | (2006.01) |
| ***E21B 47/06*** | (2012.01) |
| ***E21B 33/14*** | (2006.01) |

(52) U.S. Cl.

CPC ..... *F04B 49/08* (2013.01); *E21B 33/14* (2013.01); *F04B 1/005* (2013.01); *F04B 49/22* (2013.01); *E21B 47/06* (2013.01)

(58) Field of Classification Search

CPC ..... E21B 33/14; E21B 47/06; E21B 43/14; F04B 1/005; F04B 49/08; F04B 49/22

See application file for complete search history.

(56) References Cited

U.S. PATENT DOCUMENTS

2008/0099213 A1* 5/2008 Morrow ..... A62C 27/00 169/24

FOREIGN PATENT DOCUMENTS

CA 2790432 A1 * 3/2014 ..... E21B 33/13

* cited by examiner

*Primary Examiner* — Caroline N Butcher

(74) *Attorney, Agent, or Firm* — Heer Law; Christopher D. Heer

(57) ABSTRACT

A slow rate pumping system which includes a discharge line to receive a discharge flow of displacement fluid from a high rate pumper, a return line off of the discharge line to receive a return flow of displacement fluid, a slow rate diversion pumping line off of the discharge line for supplying a diversion flow of displacement fluid downhole, a return valve to control the return flow, and a diversion valve to control the downhole flow. A method of supplying a slow rate flow which includes receiving a main pumping flow through a return line at a pumping pressure, producing a differential pressure between the pumping pressure and a downhole pressure matching a differential setpoint, diverting a slow rate flow of fluid from the main flow using a diversion line off the return line prior to the return valve, and maintaining the differential pressure.

10 Claims, 9 Drawing Sheets

| |
|---|
| FIG. 3A |
| FIG. 3B |
| FIG. 3C |

METHOD AND SYSTEM OF SLOW RATE PUMPING

FIELD OF THE INVENTION

The present specification relates generally to pumping operations, and specifically to slow rate pumping of displacement fluid during a pumping operation.

BACKGROUND OF THE INVENTION

In a well casing operation cement is typically pumped into the well at a rate on the order of 500-2000 litres per minute, followed by displacement with a displacement fluid at 500-1000 litres per minute, forcing the cement into the annulus between the casing and the surrounding rock. While other displacement fluid may be used, water is typically preferred.

At the end a final low pumping rate of 1-100 litres per minute of displacement fluid has been found to effectively squeeze the remaining cement into the remaining gaps in the rock, providing a better seal to prevent fluid migration in the cemented annulus.

Traditional cementing equipment is configured to pump at the higher rates required for cementing and is not capable of pumping at low rates. Accordingly, a stand-alone low rate pumping unit is used in addition to the cementing unit. This stand-alone low rate pumping unit has its own powertrain, pump, tanks, measurement equipment and piping system and is driven to the well to be serviced in addition to the cementing unit.

Accordingly, there is a need for improvement in the art.

SUMMARY OF THE INVENTION

In an embodiment of the present invention, there is provided a slow rate pumping system, comprising a discharge line to receive a discharge flow of displacement fluid from a high rate pumper; a return line off of the discharge line to receive a return flow of displacement fluid; a diversion line off of the discharge line for supplying a diversion flow of displacement fluid downhole; a return valve to control the return flow; and a diversion valve to control the downhole flow.

In an embodiment of the present invention, there is provided a method of supplying a slow rate flow of fluid in a pumping operation, comprising receiving a main pumping flow of fluid through a return line, the main pumping flow of fluid received at a pumping pressure; adjusting a return valve on the return line to produce a differential pressure between the pumping pressure and a downhole pressure, the differential pressure matching a differential setpoint; adjusting a diversion valve to divert a slow rate flow of fluid from the main flow using a diversion line off the return line prior to the return valve, the slow rate flow of fluid matching a slow rate setpoint; and maintaining the differential pressure by adjusting the return valve.

Other aspects and features according to the present application will become apparent to those ordinarily skilled in the art upon review of the following description of embodiments of the invention in conjunction with the accompanying figures.

BRIEF DESCRIPTION OF THE DRAWINGS

The principles of the invention may better be understood with reference to the accompanying figures provided by way of illustration of an exemplary embodiment, or embodiments, incorporating principles and aspects of the present invention, and in which.

Like reference numerals indicated like or corresponding elements in the drawings.

DETAILED DESCRIPTION OF THE EMBODIMENTS

Figure 1:
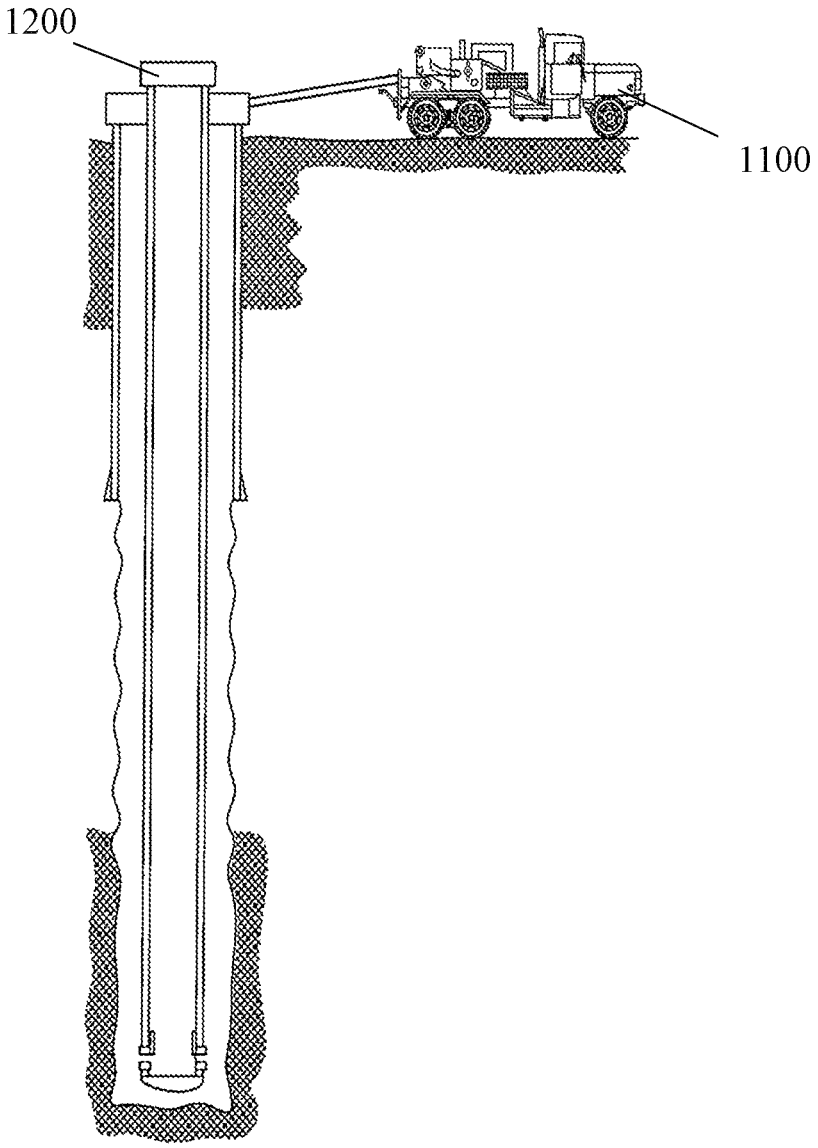
FIG. 1 is a schematic diagram of an example of a primary pumping system.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

As mentioned elsewhere herein, at the end of a cementing operation a final low pumping rate of 1-100 litres per minute has been found to effectively squeeze the remaining cement into the remaining gaps in the rock, providing a better seal to prevent fluid migration in the cemented annulus. Slow rate pumping may also be employed in other finishing-related pumping operations, including the closing of a vent in a cemented well.

Typically, primary high-flow and high-pressure pumping systems for cementing operations are not capable of pumping low rates. The engines, transmissions and well servicing pumps are set up for the higher rates required for a primary pumping stage.

As a result, this final low pumping rate is often provided by a separate low rate pump on a separate vehicle supplied in addition to the primary pumping vehicle, or by a pressure washing pump, or by using a small displacement triplex pump. In some cases, the final low pumping rate is forgone altogether. Where separate low rate pumps are used, most of these pumps are not rated for the same pressure as the primary pump used for the primary pumping operation, such as a pressure of 34 MPa or greater. In any case, the use of an additional pump results in significant space and weight consequences and may require the provision and use of an additional vehicle and additional manpower.

In some embodiments of the present invention, the seamless transition from primary displacement pumping to slow rate displacement pumping involves the use of the primary high pressure pumping system, in combination with a low flow high pressure system diverting a slow rate flow of displacement fluid from the primary high rate system. Using the primary pumping system to provide the slow rate displacement pumping allows a slow rate pumping session to benefit from the same pressure parameters as the primary pumping session, and without the need for a separate pumping vehicle or other pumping equipment.

In some embodiments, a low flow high pressure system involves a primary high-pressure system with a slow rate pumping diversion line provided off the high-pressure system discharge line. In some embodiments, valves such as the diversion valve governing the diversion line are needle valves. However, in other embodiments other types of valves can also be used, such as ball valves, and the choice of valve may affect the possible gain schedules, control, and safety of the system. In some embodiments, the diversion valve is a pressure compensated priority flow control valve design for use with water, or is configured to cooperate with pressure compensation elements of the slow rate pumping system.

In some embodiments, provision may be made to deal with blockage of the diversion valve during operation, such as blockage due to silting. In some embodiments, filters are provided to filter the displacement fluid prior to the diversion valve. In some embodiments, the diversion valve is designed to have a high tolerance for contaminated displacement fluid which would otherwise result in blockage, for example needle valves may be used rather than spool valves. In some embodiments, the slow rate pumping system may be designed to permit a purging of a diversion valve, such as using a design incorporating parallel diversion lines and valves or using a design incorporating a purge line downstream from a diversion valve.

In some embodiments, a slow rate pumping system is included in a primary pumping system, such as provided as bypass piping around a primary cementing control valve. In some embodiments, a slow rate pumping system is provided as an external addition to a primary pumping system, such as a separate system which can be connected to a discharge line of a high rate pumping system to divert a slow flow rate of high pressure displacement fluid.

In some embodiments, a control system is provided for management of a slow rate pumping operation using the slow rate pumping system. The control system may also be provided for management of the high rate primary pumping operation as well, and may be automated or partly automated.

In some embodiments, a slow rate pumping system also measures the flow rate provided downhole in real time, such as by measuring a downhole flow directly using a flow meter or by measuring the difference in flow rate discharged by a primary pumping system and retuned to a primary pumping system tank. Examples of flow meters include turbine flow meters and ultrasonic flow meters.

In some embodiments, the slow rate pumping system is designed for use in cold weather, taking into account the possibility of water retention resulting in freezing.

An example of a primary pumping system is indicated in FIG. 1. FIG. 1 depicts a vehicle-mounted primary pumping system 1100 hooked up to a well 1200 for pumping fluid such as displacement fluid or cement slurry. A primary pumping system, such as system 1100, may be driven by a high-pressure pump, such as a 34 MPa rated triplex pump. Such a pump may be configured to provide a flow in the range of hundreds or thousands of liters per minute.

Figure 2A:
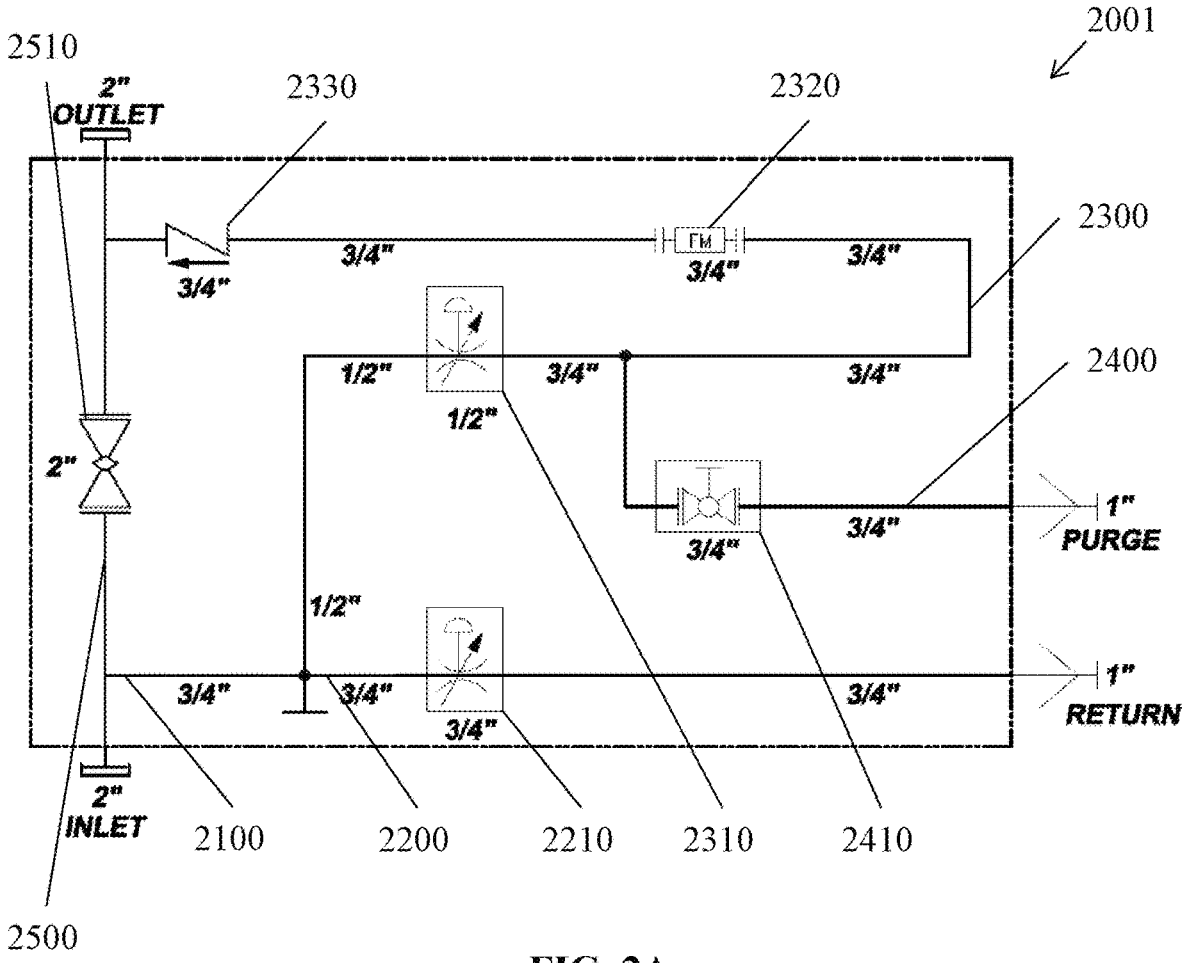
FIG. 2A is a process flow diagram of a system for slow rate pumping, according to an embodiment.

A primary pumping system, such as system 1100, may be modified for slow rate pumping. A process flow diagram of an example of a slow rate pumping system is shown in FIG. 2A. Slow rate pumping system 2001 of FIG. 2A employs a purge line configuration for dealing with silting or other blockage issues, rather than a parallel diversion line configuration or other configuration.

Slow rate pumping system 2001 includes a high flow-rate discharge line 2100, a return line 2200, a diversion line 2300, and a purge line 2400. Discharge line 2100 is the discharge line of a high flow high pressure pumping system, and is provided to feed fluid to the return line 2200 and diversion line 2300. The return line 2200 is provided to return the unused fluid flow to the primary pumping system, such as to a holding tank or another pumping operation.

The flow rate into the return line 2200 and the diversion line 2300 are controlled by needle valves 2210 and 2310, respectively. Branching off of the diversion line 2300 is the purge line 2400 controlled by valve 2410. Diversion line 2300 also includes a flow meter 2320 and a check valve 2320. Flow meter 2320 is provided to allow a real time calculation of the displacement fluid flow, and check valve 2320 is provided to mitigate sudden increase in backpressure, particularly in case pressure increases faster than diversion valve 2310 can close.

A main cementing line 2500 provides a direct downhole connection for a regular cementing operation. Main cementing line 2500 is controlled by cementing control valve 2510. The slow rate pumping system provides a way to bypass the cementing control valve 2510; for example, cementing control valve 2510 would be opened for a primary cement pumping operation to permit a high pressure primary pump to drive cement through to the well, and then would be closed once the cementing is complete at which point a slow rate pumping operation can begin using diversion line 2300 and associated slow rate piping to implement a slow rate pumping operation.

Valves, such as needle valves 2210 and 2310, may be electrically controlled valves, allowing the system to be centrally managed. The purge line 2400 is provided to allow the lines to be purged when necessary, such as to clear a blockage of needle valve 2310.

Figure 2B:
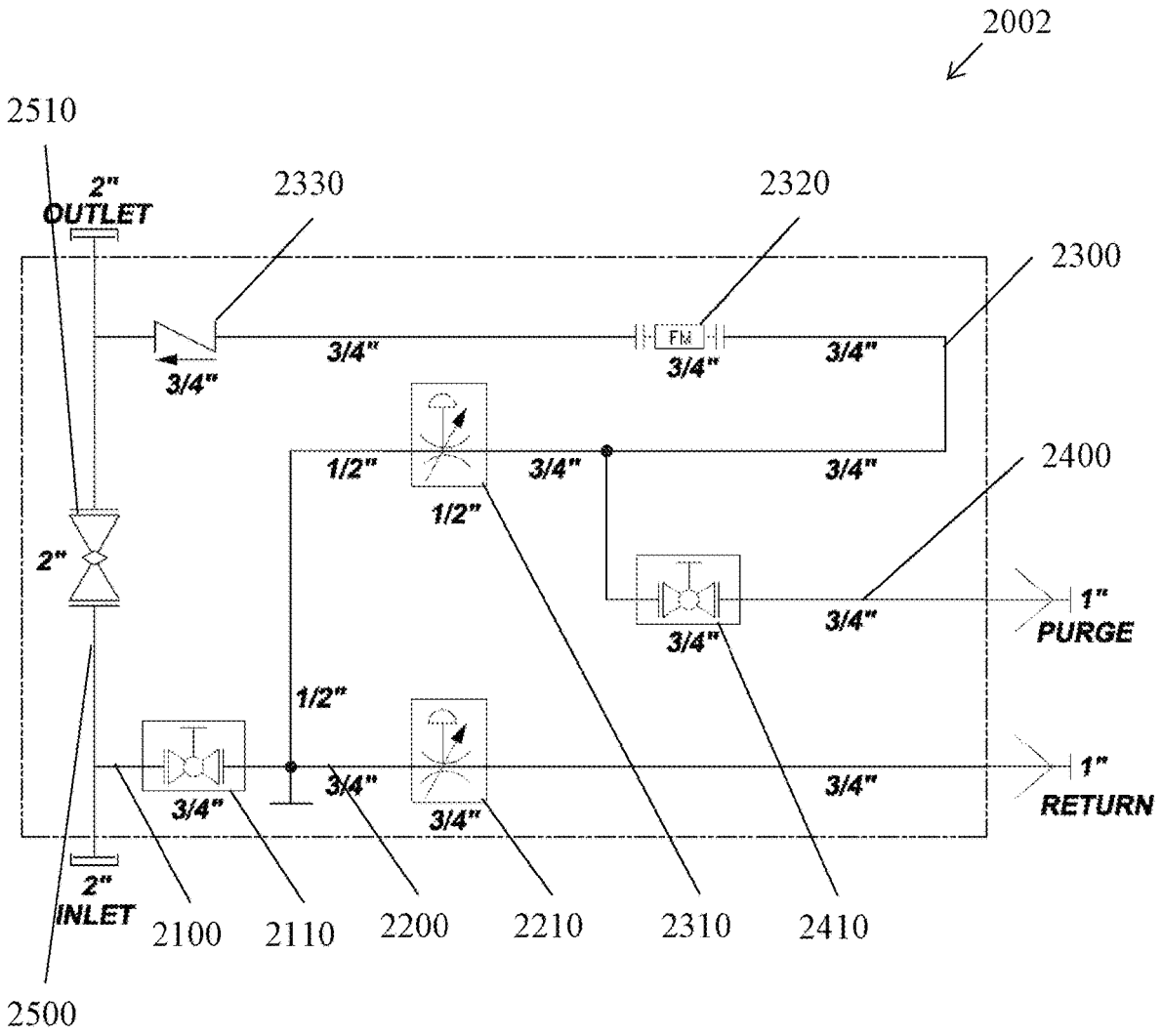
FIG. 2B is a process flow diagram of a system for slow rate pumping, according to an embodiment.
Figure 2C:
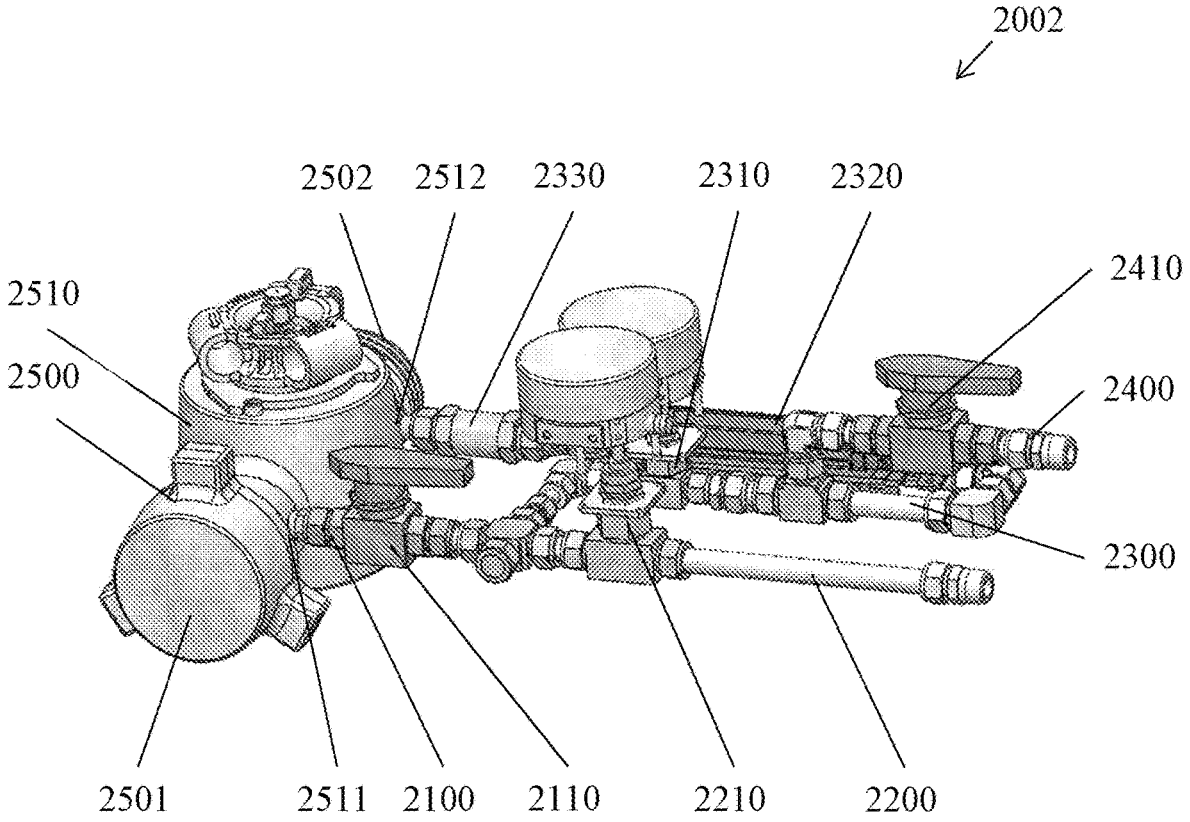
FIG. 2C is a schematic perspective view of the system of FIG. 2B.

As shown particularly in FIG. 2C, cementing control valve 2510 is a plug valve forming a main cementing line 2500 having an inlet end 2501 and an outlet end 2502. The cementing control valve 2510 includes ports added for the slow rate pumping operation piping, an outlet port 2511 and an inlet port 2512 provided to allow the slow rate piping to bypass the cementing control valve 2510. Various connections may be used to connect valves and other components into the piping system, for example in some embodiments Swagelok connections may be used.

The slow rate pumping system 2001 functions on a two-loop system. The diversion needle valve 2310 runs on a flow loop; a desired flow rate is set on a control system and the downhole diversion valve 2310 is controlled based on the reading of the flow meter 2320, and is adjusted to maintain a steady flow matching a downhole setpoint set by a user. The return needle valve 2210 is used to form a pressure loop; the slow flow rate system will only start providing displacement fluid downhole once a pressure differential has been established between the pump or inlet pressure and the downhole or outlet pressure which matches a pressure setpoint set by a user, such as 4 megapascal ("MPa"). The pressure differential ensures that the pump pressure is higher than the downhole pressure and may amount to approximately 140 L/min circulating through the slow rate pumping system. Once a correct pressure differential has been established the diversion needle valve 2310 will be signaled to begin the flow loop and will open until the desired flow rate is achieved and will adjust based on the return flow rate and continuous input flow rate. The return needle valve 2210 will be adjusted based on sensed inlet and outlet pressures to maintain the pressure differential at the pressure setpoint. The two loops, a flow loop and a pressure loop, work independently of one another in system 2001.

A purge valve 2410 is connected to the piping of the diversion needle valve 2310 to allow the diversion valve 2310 to be purged, such as in case it has silted closed or something is stuck in the diversion needle valve 2310 and needs to be purged out. If a blockage of valve 2310 is detected, such as by a decrease in diversion flow, a system which includes a purge line may trigger a purge of the valve 2310.

In some embodiments, during a purge using the systems of FIG. 2A or FIG. 2B, the pump and downhole piping is blocked and a flow of purging fluid is introduced through the purge line to enter valve 2310 from the downhole direction and to exit the system through line 2200. For example, in the system of FIG. 2A the pump is stopped, valve 2310 is fully opened, valve 2210 is fully opened, valve 2510 is fully closed, and the well head is closed. Valve 2410 is opened, and clean fluid from a separate pump on the unit enters through the purge line and through 2310, unclogging the debris and forcing it out through 2210. Valve 2410 will typically remain closed unless a blockage is detected.

In some embodiments, in/out connections are provided on a slow rate pumping system for power, legacy unit support and communications. These connections may be wired or wireless.

Figure 2D:
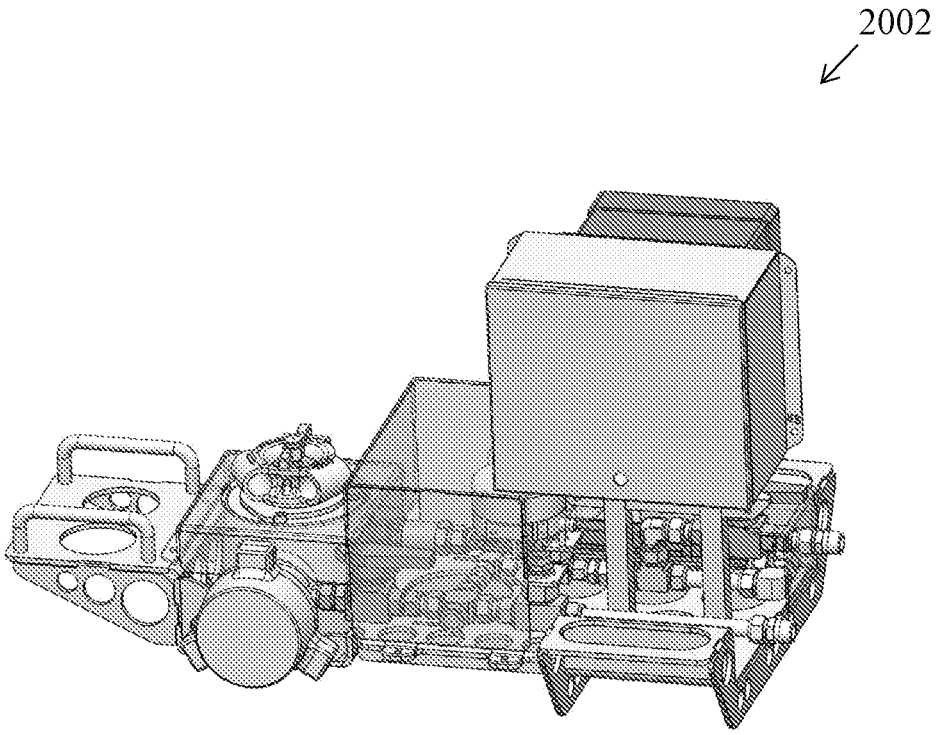
FIG. 2D is a schematic perspective view of the system of FIG. 2B with cooperating electrical boxes and brackets.

FIGS. 2B, 2C, and 2D show an embodiment of a piping system similar to the slow rate pumping system 2001 of FIG. 2A. As shown particularly in the process flow diagram of FIG. 2B, piping system 2002 is similar to slow rate pumping system 2001, but also includes an isolation valve 2110 on discharge line 2100. Isolation valve 2110 is provided to allow discharge line 2100 to be shut. For example, to close the slow rate pumping part of the piping system when piping system 2002 is being used for a primary pumping operation or if system 2002 is to be used in a pumping or cementing job which is not going to include a slow rate pumping session. Closing the slow rate pumping part of the piping system 2002 may prevent cement buildup in the piping or other damage to the piping.

FIGS. 2C and 2D are schematic perspective views of piping system 2002, without and with electrical boxes and brackets, respectively. Brackets are required in some embodiments to permit the piping system to be more easily secured to a larger piping array or system array. Electrical boxes are required in some embodiments to allow for more direct control over valve operation, such as electrical valve control run by an automatous or partially autonomous operation.

In some embodiments, well pressure is measured directly for the purposes of the slow rate pumping system. In some embodiments, the well pressure is approximated by the pressure of the downhole discharge of the slow rate pumping system rather than being measured directly. Similarly, in some embodiments a pumping pressure is approximated by the pressure of fluid received into the slow rate pumping system.

In some embodiments, a slow rate pumping system is controlled by a control system. In some embodiments, the control system is manually operated, such as with a user initiating a primary pumping system and opening and closing valves as needed. However, in some embodiments, aspects of a slow rate pumping system are automated. In some embodiments, an automated control system is provided for a slow rate pumping system to minimize operator involvement in controlling at least certain basic operations. In some embodiments, an automated control system may control the operation of slow rate pumping system during normal pumping operations, such as to respond to flow rate and pressure setpoints and instructions by opening or closing relevant valves. In some embodiments, a control system may also be provided to handle issues, such as silting, by implementing a programmed purging operation or other operation.

A control system may be run on dedicated control hardware in some embodiments, such as a processor and a display integrated with the primary and slow rate pumping systems. In some embodiments a control system may be run on multipurpose or dispersed hardware, such as on a general-use mobile device interfacing with the slow rate pumping system, including wirelessly or remotely in some embodiments.

In some embodiments, due to the stepped rate nature of a slow rate pumping job, an automated control system may be implemented in stages. Each stage may include a set of three parameters; target rate, target volume, and stage max pressure. The target rate is the downhole pumping rate that the system aims to achieve for the duration of the stage, such as 20 liters per minute (LPM), 10 LPM, 5 LPM, 2 LPM, or 1 LPM or similar, and in some embodiments a target rate must be entered as a whole number of liters per minute. The target volume is the total volume that is to be displaced in a stage and may again be entered as whole liters. In some embodiments a target volume may not be needed for the control system to implement the staged operation, such as if the staged operation is to proceed on the basis of pressure without regard to pumped volume. The stage max pressure is the maximum wellhead pressure that the system can run to for the current stage and may be entered as whole Megapascals ("MPa") in some embodiments.

In some embodiments, a user of an automated control system may be able to modify stage information while the slow rate pumping system is active, and in some embodiments any such modifications are entered into an event log. The event log may be a record stored locally or remotely and used to record various operator actions and operational parameters and setpoints.

As an example, a slow rate pumping job may be set up as three stages, with an operator or supervisor or other user entering a maximum pressure, a target rate, and a target volume for each of the three stages, with an event log recording situational details such as actual volume pumped in each stage. TABLE 1 below provides the numbers of an example pumping operation, providing a hypothetical actual recorded volume used to provide further operational information.

TABLE 1

| Example parameters | | | | | | |
|---|---|---|---|---|---|---|
| # | Max Pressure (MPa) | Target Rate (LPM) | Target Volume (L) | Total Vol (L) | Act Vol (L) | Vol. Remaining (L) |
| 1 | 8 | 20 | 200 | 200 | 200.5 | −0.5 |
| 2 | 8 | 10 | 200 | 400 | 153.6 | 43.4 |
| 3 | 10 | 5 | 100 | 500 | 92.7 | 7.3 |
| 4 | | | | | | |
| 5 | | | | | | |
| | | | | Total (L): | 446.8 | 53.2 |

In some embodiments, other numbers of stages may be used, such as four or five stages for non-standard job profiles. In some embodiments, the system transitions to a subsequent stage based on when maximum pressure is reached, and so the target volume may not be reached and in some cases may not need to be entered by an operator or other user. In some embodiments, even when a target volume is entered, the control system may maintain the stage until the maximum pressure event is reached.

In some embodiments, for a final stage the pumping will be ended when either a maximum pressure is reached, or a total stage volume is reached.

In some embodiments, system response rates may be improved by having both the downhole needle valve and the return needle valve adjusted concurrently. However, in some embodiments valves may be adjusted sequentially or without regard to adjustments of other valves.

In some embodiments, options include maintaining normal pumping operations, recovering a pumping rate by purging a valve, or bumping up the pressure on the well as needed.

In some embodiments, a user interface screen or certain user interface options may only be accessible when a slow rate pumping system is connected to the automated control unit.

Figures 3, 3A:
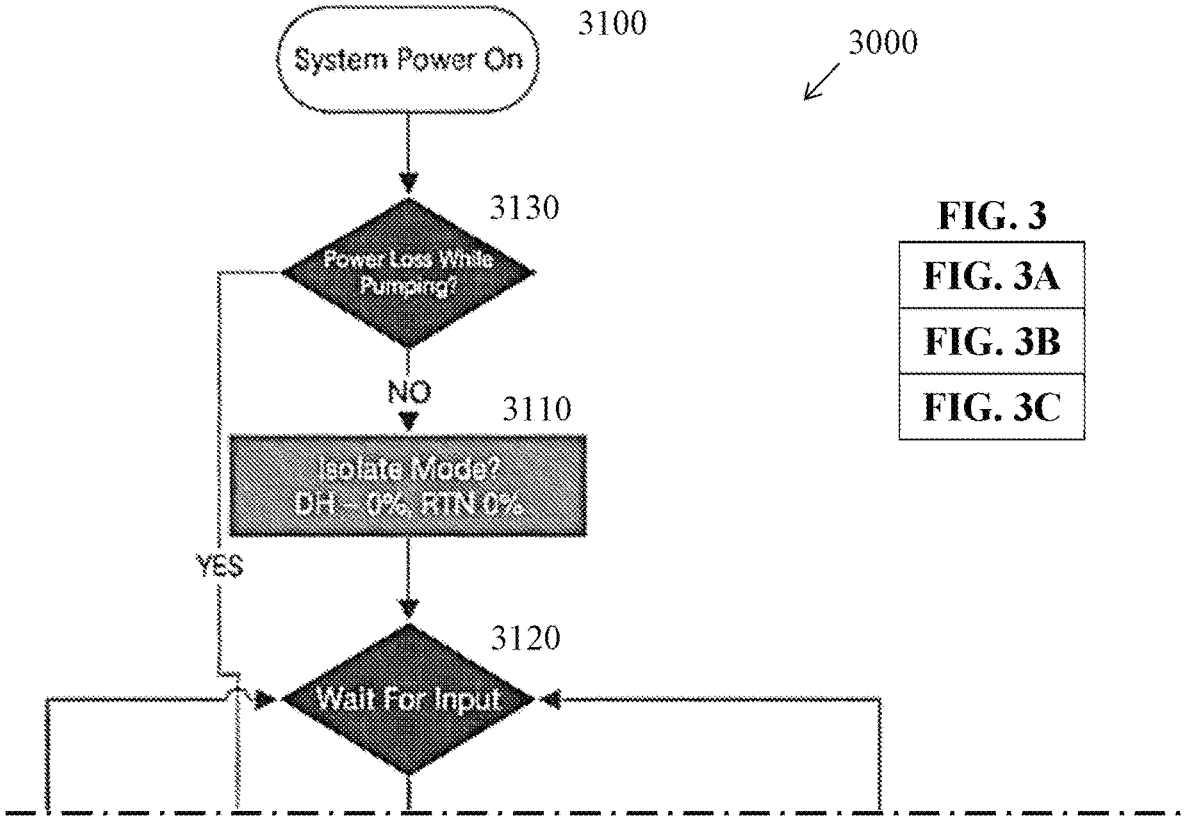
FIG. 3 is a flow diagram of a method of slow rate pumping shown in partial views across FIGS. 3A, 3B, and 3C, according to an embodiment.
Figure 3B:
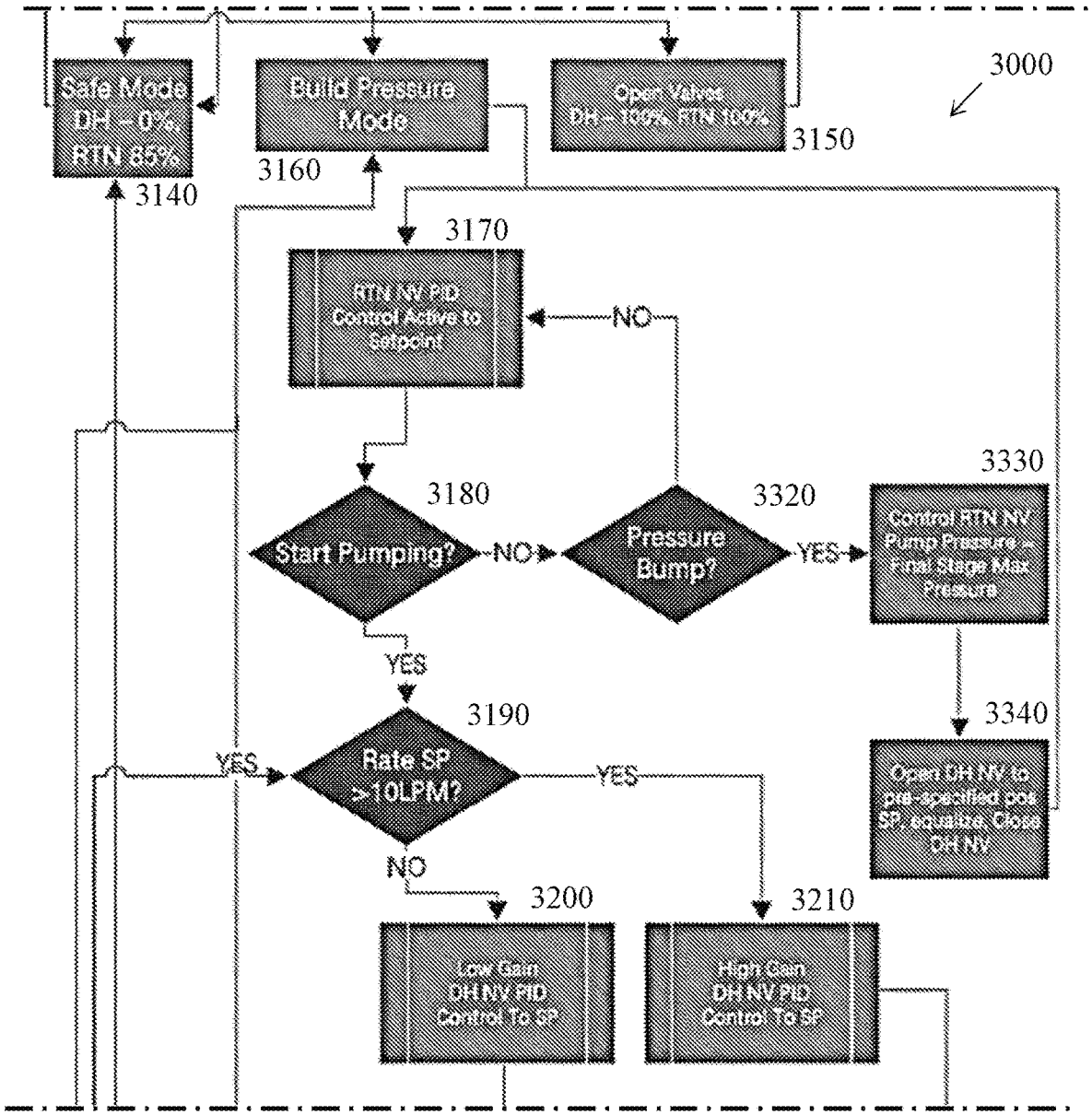
Figure 3C:
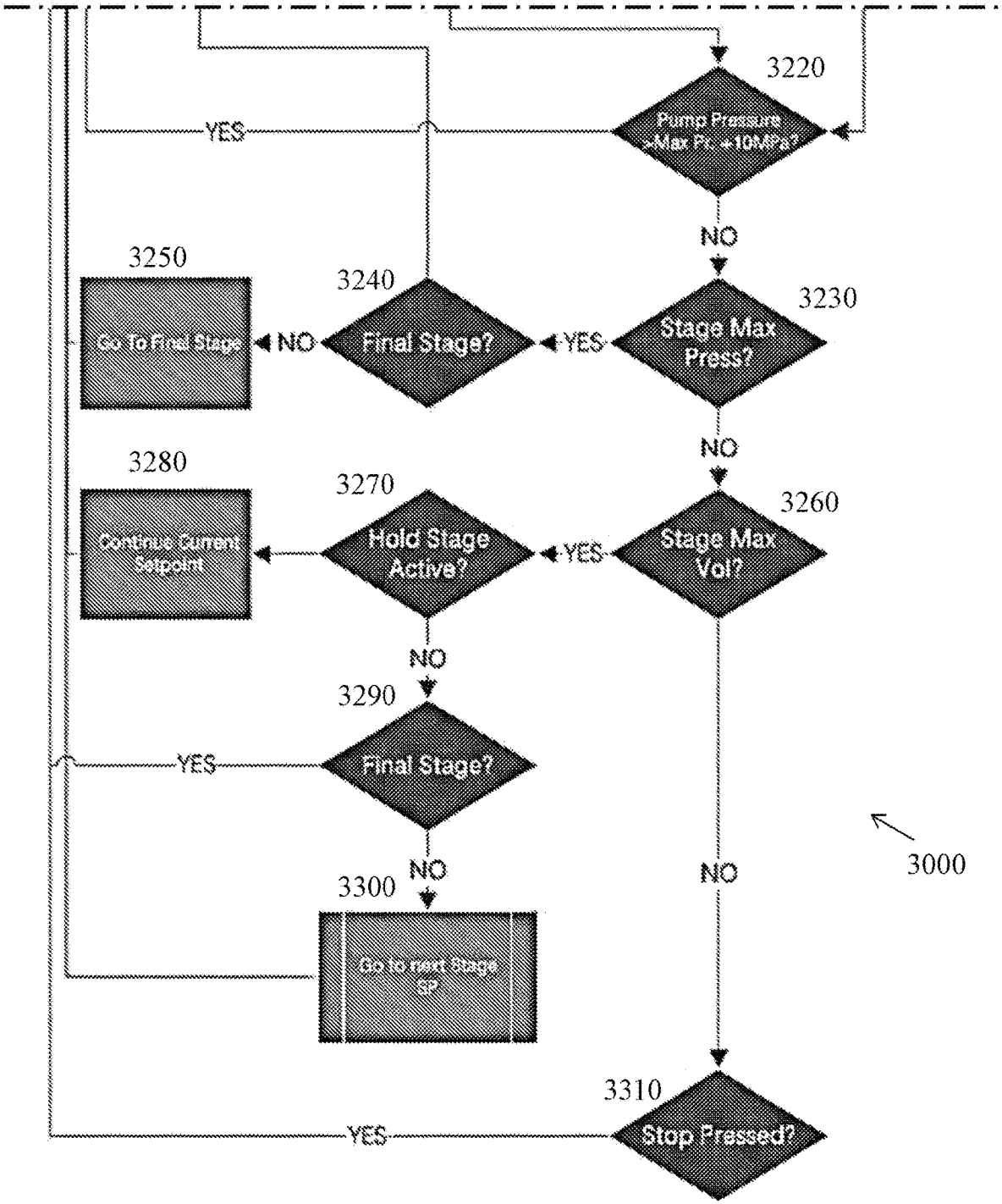

A flow diagram 3000 of an example control system is shown in partial views across FIGS. 3A, 3B, and 3C. The control system is initiated at step 3100 when the system is powered on. As shown at step 3100, when the system starts up, it automatically goes into an isolate mode at step 3110, with both a return valve, and a diversion valve closed, the valves indicated as a 'RTN' valve and a 'DH' or 'downhole' valve, respectively, in FIG. 3. In some embodiments, the system may also include a dedicated 'isolate' toggle which can be triggered by an operator to isolate the downhole portion of a slow rate pumping system. The system remains in isolate mode at step 3110 until input is received from a user at step 3120, such as instruction to begin a slow rate pumping operation.

As shown at step 3130, the system checks for power loss or other safe mode conditions throughout the pumping process, and if a loss of communications or power or similar safe mode condition is detected the slow rate system will revert back to a safe mode or ready mode at step 3140. When in safe mode, the system will activate the Quick to Neutral (QTN) function on the primary pumper and close the diversion line and open the return line, such as by closing the diversion needle valve to 0% open and opening the return needle valve to 85% open. Just as when in isolate mode at step 3110, the system will remain in safe mode 3140 until input is received from a user at step 3120. In some embodiments, a safe mode may be triggered manually using a 'ready mode' or 'safe mode' toggle.

In some embodiments, user overrides may be available for various operations available through a control system, such as moving a pumping operation forward a stage, moving backward a stage, or otherwise overriding the usual operation of the control system. In some embodiments, user-implemented overrides, such as triggering a safe mode toggle or manually moving from one stage of a slow rate pumping operation to another, may require confirmation via a confirmation pop-up. In addition, in some embodiments, alarms, notifications, and logging of information may be automatically triggered by detected issues or detected changes of stage or detected operation completions.

Input is received from a user at step 3120. The user may decide to initiate a calibration routine at step 3150. A lack of calibration can at times cause issues in operation, such as if valve opening and closing operations do not proceed as directed. Calibration of the valve positions and feedback of the system represented by flow diagram 3000 can be accomplished automatically using the control system. For example, a system may include valves driven by electric actuators, such as electric Hanbay™ actuators which provide fine movement control and position feedback. In some embodiments, an actuator or other component may include a built-in heater to combat freezing in cold conditions. A calibration cycle may include driving each valve to maximum open, such as with a 20.5 mA current setpoint. This ensures that the valve is fully open and an accurate value for the max open feedback can be obtained. Once this value is captured, the system will close the valves slightly, such as to 19.5 mA and then slowly creep the command output up until the maximum feedback mA value is achieved. This value will be stored as the 100% command mA for the respective valve. After this cycle has completed, the valves will be calibrated to obtain the 0% open feedback value, such as with a 3.5 mA current setpoint. The valves can then be re-opened to 4.5 mA and slowly closed to obtain the 0% open command values. In other embodiments, other calibration steps may be substituted or added. In some embodiments, once a calibration cycle is completed, the valves will do a complete open and close cycle to allow the user to verify that all feedback and command signals are in alignment.

The user may also decide to begin a slow rate pumping operation. Beginning an operation may start with building pressure at step 3160. A build pressure mode is a default mode that the system returns to when pumping or a pressure bump has ended, as discussed further below. In this mode the return needle valve is under the operational system control to maintain the differential pressure required between the pump and the well and set at a differential pressure setpoint by an operator. The diversion needle valve is closed. Having this mode as a default mode keeps the system ready for pumping and does not waste additional time to get the differential pressure loop running and balanced. In some embodiments, it can be separately started via a 'build pressure' toggle on the user display. In some embodiments there would be no confirmation dialog on this 'build pressure' toggle since this is a system default mode.

At step 3170 the control system controls the return valve based on a pressure differential setpoint. For example, if a pressure differential setpoint is set to 4 MPa, the control system may adjust the return valve to achieve the minimum differential pressure of 4 MPa, and may signal a readiness to open the diversion valve when the differential pressure loop is close to the setpoint, such as within 25% of its set point. The diversion valve may then be ready to be opened to achieve the flow rate setpoint, such as a diversion flow rate of 10 LPM, with the return valve continually monitored and adjusted to maintain an acceptable differential pressure.

It is determined at step 3180 whether to begin a pumping stage of the slow rate pumping system.

In some embodiments, to aid in better performance with different flow rate setpoints, two control system gain schedules are available to be applied in valve operation. The gain schedule employed may be determined by the operational limits of the valves, and may affect how quickly the system is able to adjust. One set of control system values is applied for flow rate setpoints below 10 L/min, and another larger set of control system gains is applied for set points >10 L/min. The set point changes are linearly ramped from the current measured flowrate to the final required flowrate value (obtained from the stage table). This ensures a smooth transition of flow rate values with minimal overshoot or undershoot when reaching the desired set point. The ramp rate (slope) is configurable, and in some embodiments is set to around 0.3 lpm/s.

In flow diagram 3000, if it is determined at step 3180 to being pumping, and the control system determines whether the pumping rate is to be greater than 10 LPM at step 3190. If the rate is not greater than 10 LPM the control system applies a low gain at step 3200. If the control system determines that the rate is greater than 10 LPM at step 3190, the control system applies a high gain at step 3210.

In either case, the control system checks for a pressure greater than an acceptable tolerance at step 3220. In some embodiments, this tolerance check is continuous or periodic, and not limited to checking after a diversion needle opening. If the acceptable tolerance is surpassed, the control system sets the system into a safe mode at step 3140. For example, the acceptable tolerance may be set to a maximum stage pressure level plus a margin of 10 MPa.

As each stage is pumped, the system will monitor the downhole pressure vs. the stage max pressure. If the stage max pressure is reached the system will automatically transition to the final programmed stage and continue to pump until the final stage max pressure or the final stage volume setpoint is achieved. Once either final setpoint is reached the system will first activate the quick to neutral (QTN) function on the pumper, then close the diversion needle valve and open the return needle valve. The check valve installed at the slow rate pumping system discharge will prevent any back flow through the slow rate pumping system while the diversion needle valve is closing.

If the acceptable tolerance is not surpassed, the system may continue pumping at a rate set by the user for the pumping stage until one of a stage maximum pressure or stage maximum volume is reached.

It is often desirable to have the control system operate based on a treating pressure setpoint. In these cases, the system would use the stage max pressure as the setpoint for the diversion valve control system rather than the target rate or volume value. In some embodiments, the return needle valve would maintain the same pressure loop control setpoint of 4 MPa as per rate pumping mode. The diversion downhole rate for slow rate pumping will be limited to a maximum of 20 LPM in some embodiments. In some embodiments, once the programmed stage volume has elapsed the system will conduct a normal shutdown sequence.

If it is determined at step 3230 that a stage maximum pressure is reached the control system either enters a default build pressure mode if the stage is the final slow rate pumping stage at step 3240 or triggers an initiation of a final stage at step 3250. If a stage maximum volume is reached at step 3260, the control system determines whether a 'hold stage' function is active at step 3270. If a hold stage function is active, the control system ignores a stage volume limit and continues pumping at step 3280 until either the stage pressure value is reached, the user manually stops the stage at step 3310, or the hold stage function is deactivated and the volume limit is reached.

If the hold stage function is not active then the control system determines whether the stage is a final stage at step 3290, if it is a final stage the pumping operation is complete and the control system returns to a build pressure mode at step 3160. If the stage is not the final stage at step 3290, the pumping operation goes onto the next stage at step 3300, cycling back to step 3190.

In some embodiments, the hold stage function state is not saved to a configuration file, so its position is reset whenever the controller is rebooted. In some embodiments, it is never automatically reset in any other case, so the user may need to reset it when it is not required.

The control system can also accept a manual stop instruction at stage 3310, at which point the control system will trigger a return to a default pressure build mode at step 3160.

Once a normal slow rate job cycle has completed, it is common for the treating pressure to fall off and the cement to relax into the wellbore. The user may be called upon to bump the well pressure back to the final stage maximum pressure several times to ensure proper product placement.

At step 3180, the user has the option of initiating a pressure bump at step 3320. When activated, the control system will use the values of the last stage and the current pump pressure to control the process. The system will control the pump pressure via adjustments to the return needle valve, to a target pressure as entered as the final stage maximum pressure value. At any time, the user can adjust the diversion needle valve opening manually to any desired value (0 to 100%). In this mode, the downhole or diversion flow rate achieved is relatively unimportant and uncontrollable since the well pressure is roughly balanced to the pump pressure, hence the diversion needle valve may not be under automatic control in some embodiments. The programmed rate and stage volumes are ignored in this mode. If the wellhead pressure reaches max setpoint before the diversion needle valve achieves the flow rate setpoint the system will shut down as per the normal shutdown procedure.

In operation, often the downhole rate shows a tendency to slowly drop off, such as due to silting while pumping with the downhole needle valve <7% open. For example, both the return needle valve and the diversion needle valve may be stationary, indicating that the cause is fine debris plugging the orifice of the downhole diversion needle valve.

In some embodiments, adding a filter to the system to catch this debris is not acceptable so an alternative method of dealing with silting needs to be implemented. Momentarily opening the diversion valve to a value of >7% is often effective in some embodiments at flushing the debris from the diversion valve and re-establishing flow. This operation has a negative side effect that the downhole flow rate momentarily spikes until the diversion valve is returned to the proper position. To combat this, the control system may be put in recovery mode when the algorithm detects that the rate is falling due to silting.

A recovery mode may be different from a normal pumping mode in that the return valve pressure differential setpoint may be reduced from 4 MPa differential pressure to 2 MPa. By opening the return valve and dropping the pressure differential there will be less of an effect on the target rate or pressure when the diversion valve suddenly clears the blockage. In some embodiments, there will be no other differences in system operation beyond the return valve set point change, and normal control system operation will resume with the diversion valve opened to achieve the target flow rate setpoint. In some embodiments, the slow rate pumping system may also include design features to control the effects of a purging operation, such as discussed above.

In many cases, during operations there are two key pressures that must be monitored, the pump discharge pressure and the downhole treating pressure. In some embodiments, the pump discharge pressure may be read by the slow rate pumping system's input pressure transducer, and the downhole treating pressure may be read via a discharge transducer in the slow rate pumping system.

In some embodiments, when interfacing with a primary pumping system unit, the slow rate pumping system control system will automatically set overpressure trip points according to user-entered stage information. For example, the pump overpressure setpoint may be configured as the last stage max pressure +10 MPa to allow for a sufficient differential pressure between the triplex and discharge and may be applied at step 3190 of flow diagram 3000. The control system may also be configured to activate the QTN functions of the pumper when well pressure reaches the last stage max pressure as part of the normal shutdown routine.

In some embodiments, such as provided for use with legacy pumpers, a slow rate pumping system will augment the mechanical overpressure system already installed in a legacy unit. This may require each of the legacy units to be updated to interface with the slow rate pumping system's overpressure system. In such embodiments, the slow rate pumping system may utilize a single digital output to trigger the overpressure system of the legacy pumper when the last stage max pressure is reached. In some embodiments, the user is responsible for configuring the data system.

In some embodiments, the well treating pressure is a separate entry on the slow rate pumping system operating screen.

Normal pumping operations will often require the operator to pre-program the stage information into the system and meet the system interlocks before the control system automatic features will take over. In some embodiments, when making rate adjustments the control system will re-position both needle valves at the same time to speed up the system response. Making changes to one of the valves will affect the response of the other control loop and vice versa, accordingly the control system must tune the loops without having the responses fight each other.

In some embodiment, at the end of a slow rate pumping operation the lines are disconnected from the primary pumping system and from the well and are drained. This too may be an automated operation or may be triggered by a toggle on a control screen. A confirmation dialog will be generated when the toggle is triggered, and a warning message will be generated if drain safety conditions are not met such as lines remaining connected to the primary pumping system or the well. Since the system will automatically go to an isolate mode at step 3110 when it loses connectivity with the control interface, in some embodiments the order of operations should be: verify pressures and flows as measured by the hardware are near zero; disconnect hoses; trigger the drain valves toggle; verify there is no warning that drain conditions were not met; verify that the control system status indicates "drain mode-both valves open"; and, while connected to the slow rate pumping system hardware via ethernet, cut power to the slow rate pumping hardware to ensure the valves are in the open position when powered down. Next time the slow rate pumping hardware is powered up, the valves will automatically go to the isolate mode.

In some embodiments, decisions and setpoints entered by a user may be part of a preprogrammed routine, rather than requiring real-time entry by the user.

In some embodiments, the control system is connected to both the slow rate pumping system and the high rate pumping system, to control, log, and transmit information. For example, a LabVIEW-based control application may be provided.

Figure 4:
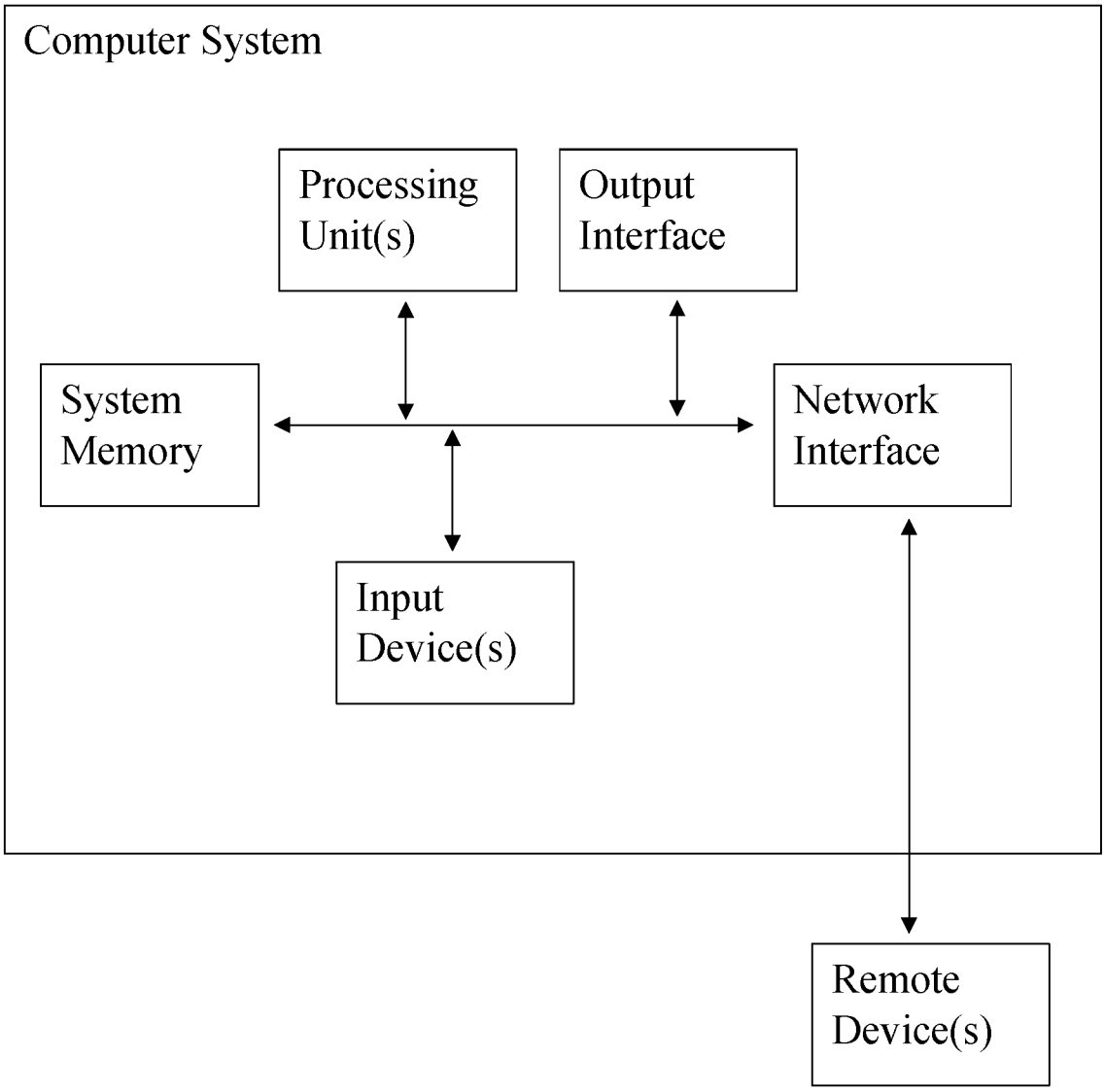
FIG. 4 is a schematic diagram of a computer system used to control a slow rate pumping system, according to an embodiment.

Embodiments of the present invention may be implemented using computing devices, such as the computer system depicted in FIG. 4. The computer system may execute computer instructions to perform steps involved in operating vales, measuring pressure, transitioning to different operational stages, recording operational parameters, and other processing related to embodiments of the present invention.

As depicted in FIG. 4, a computer system may include a processing unit and a system memory which may be interconnected across a system bus or network. The computer compilation system may have access to computer readable media, and the system memory may include computer readable storage media in the form of volatile and/or non-volatile memory such as read only memory and/or random-access memory. In some embodiments system memory may include an operating system, application programs, and program data.

A user using the computer system depicted in FIG. 4 may interface with the computer through input devices, such as a mouse or keyboard, to provide information and instructions. A user may receive information from the system from output devices, such as a monitor or network or output interface, to receive readouts of operational parameters or a listing of control system options. In some embodiments a computer system may be networked and operable as a distributed system, a computer system may also be able to access distributed databases for information or processing capability.

Some embodiments may be implemented as a system, a method, or a computer program product. Accordingly, aspects of the invention may take the form of an entirely hardware embodiment, an entirely software embodiment (such as including firmware and resident software) or an embodiment combining software and hardware aspects. Aspects of some embodiments may take the form of a computer program produced embodied in one or more computer readable medium having computer readable program code embodied therewith.

Various embodiments of the invention have been described in detail. Since changes in and or additions to the above-described best mode may be made without departing from the nature, spirit or scope of the invention, the invention is not to be limited to those details but only by the appended claims.

What is claimed is:

1. A method of supplying a slow rate flow of fluid in a pumping operation, comprising:

receiving a main pumping flow of fluid through a return line, the main pumping flow of fluid received at a pumping pressure;

adjusting a return valve on the return line to produce a differential pressure between the pumping pressure and a downhole pressure, the differential pressure matching a differential setpoint;

adjusting a diversion valve to divert a slow rate flow of fluid from the main flow using a slow rate pumping line off the return line prior to the return valve, the slow rate flow of fluid matching a slow rate setpoint; and maintaining the differential pressure by adjusting the return valve.

2. The method of claim 1, wherein the pumping pressure is at least 20 megapascals.

3. The method of claim 2, wherein the slow rate flow is 10 liters per minute or less.

4. The method of claim 1, further comprising;

detecting a blockage of the diversion valve;

adjusting the diversion valve to purge the diversion valve; and adjusting the diversion valve to re-establish the slow rate flow of fluid through the diversion valve.

5. The method of claim 1, wherein adjusting the diversion valve to divert the slow rate flow of fluid from the main flow using the slow rate pumping line off the return line includes performing a slow rate pumping operation including:

initiating a first stage of a slow rate pumping operation by setting the slow rate flow to a first stage flow rate;

detecting a first stage completion criteria;

initiating a second stage of the slow rate pumping operation by setting the slow rate flow to a second stage flow rate, the second stage flow rate being smaller than the first stage flow rate;

detecting a second stage completion criteria; and concluding the slow rate pumping operation.

6. The method of claim 5, wherein adjusting the diversion valve occurs at a high gain when the slow rate flow is greater than a threshold flow and occurs at a low gain when the slow rate flow is less than or equal to a threshold flow.

7. The method of claim 5, wherein the pumping operation is a cementing operation, further comprising, prior to concluding the slow rate pumping operation, allowing a cement relaxation time to elapse and then bumping the downhole pressure.

8. The method of claim 5, further comprising prior to concluding the slow rate pumping operation:

initiating a final stage of the slow rate pumping operation by setting the slow rate flow to a final stage flow rate, the final stage flow rate being smaller than the second stage flow rate; and detecting a final stage completion criteria.

9. The method of claim 5, wherein detecting a first stage completion criteria includes:

monitoring the well pressure;

detecting that the well pressure matches a first stage maximum pressure; and determining that a first stage completion criteria is detected.

10. The method of claim 5, wherein detecting a first stage completion criteria includes:

determining that a hold stage active function is deactivated;

calculating a total first stage diversion volume;

detecting that the total first stage diversion volume matches a stage target volume; and determining that a first stage completion criteria is detected.

* * * * *